US005829586A

United States Patent [19]

Mermell

[11] Patent Number: 5,829,586

[45] Date of Patent: Nov. 3, 1998

[54] FIREARM SAFETY STORAGE BOX

[75] Inventor: Melvin W. Mermell, Bloomfield Twp, Mich.

[73] Assignee: Irrevocable Trust of Melvin W. Mermell, Lake Orion, Mich.

[21] Appl. No.: 562,853

[22] Filed: Nov. 27, 1995

[51] Int. Cl.[6] ..... B65D 85/00

[52] U.S. Cl. ..... 206/317; 206/525; 220/4.01

[58] Field of Search ..... 206/317, 315.11, 206/523; 220/4.09, 4.01, 4.28, 4.03, 4.08

[56] References Cited

U.S. PATENT DOCUMENTS

| | | | |
|---|---|---|---|
| 2,488,368 | 11/1949 | Bickham | 206/318 |
| 3,266,656 | 8/1966 | Kridle | 220/4.28 |
| 3,655,087 | 4/1972 | Luisada | 220/4.28 |
| 3,989,157 | 11/1976 | Veenema | 220/4.28 |
| 4,446,900 | 5/1984 | Markovich | 206/317 |
| 5,149,203 | 9/1992 | Sacks | 206/317 |
| 5,431,970 | 7/1995 | Broun et al. | 206/317 |

*Primary Examiner*—Paul T. Sewell
*Assistant Examiner*—Luan K. Bui
*Attorney, Agent, or Firm*—Arnold S. Weintraub

[57] ABSTRACT

A firearm safety storage box which is substantially child and theft resistant without using hinges and mechanical locks. The box has an access panel which is not permanently sealed to any other portion of the box and which is only disclosed to the user of the box. The box also has a bullet-proof panel to protect against the accidental firing of the firearm during mishandling of the box. The box may be used to safely store valuable items other than firearms.

12 Claims, 2 Drawing Sheets

FIG 1
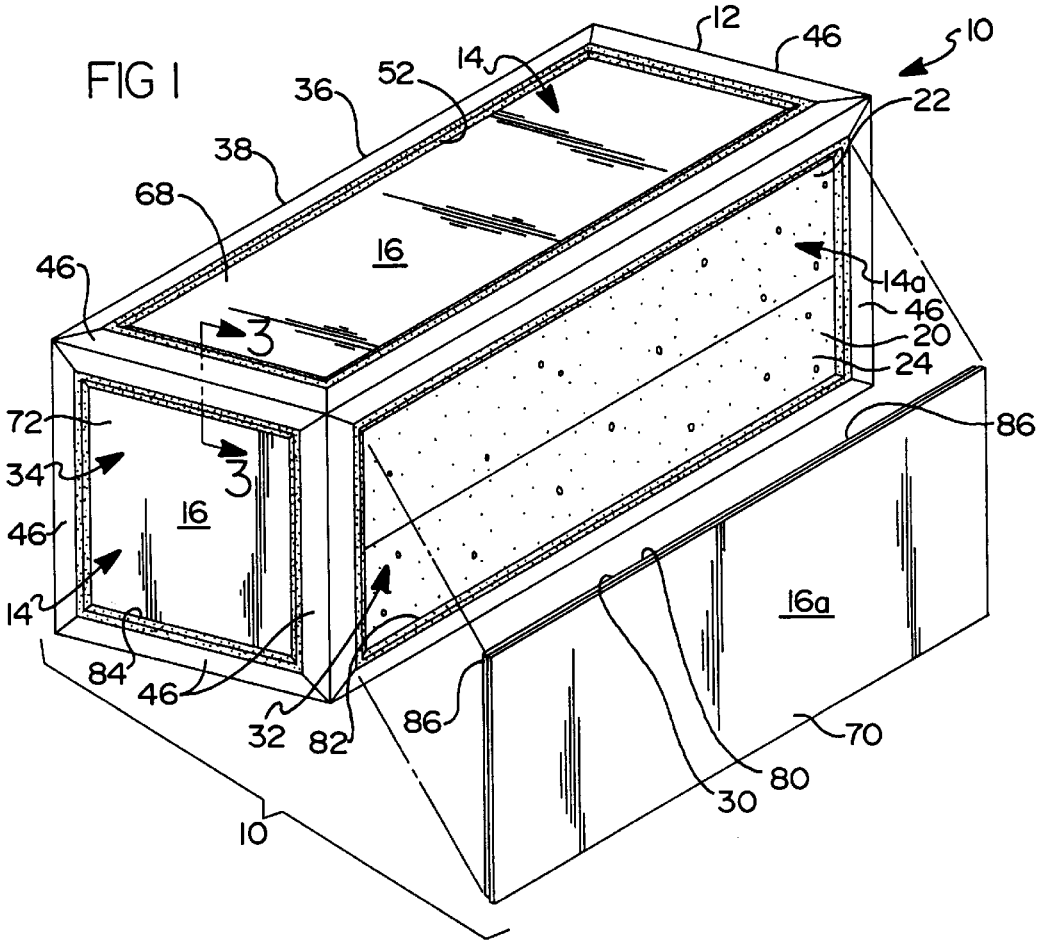
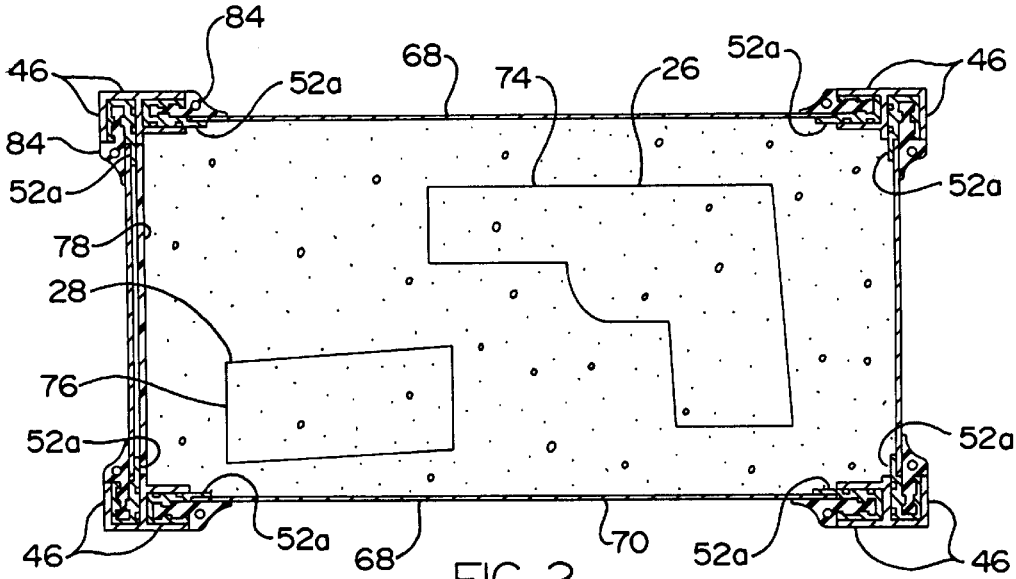
FIG 2

FIREARM SAFETY STORAGE BOX

BACKGROUND OF INVENTION

1. Field of Invention

This invention generally relates to safety storage boxes for firearms, and more particularly to safety storage boxes for storing hand gun type of firearms.

2. The Prior Art

Traditionally, hand guns or firearms have been stored in unlocked drawers, locked drawers, unlocked cabinets, locked cabinets and other types of locked and unlocked non-specific containers. Because of the safety problems with these traditional storage areas, there has been a continuous effort to design containers for the safe storage of hand guns.

The large majority of safety storage containers have been brief case type locked containers which are accessed by key or by a combination lock. Each of these containers attempted to incorporate some safety features into the container.

Typically these types of containers are those disclosed in U.S. Pat. No. 3,307,755 and U.S. Pat. No. 3,369,721. U.S. Pat. No. 3,307,755 discloses a carrying case for a hand gun which includes a top and bottom that are connected by hinges and are locked by a combination lock. A rod is inserted within the barrel of the gun and locked in place to prevent the firing of the gun while it is stored within the case. U.S. Pat. No. 3,369,721 discloses a hand gun carrying case similar to that disclosed in the '755 patent except for an additional safety lock used on the rod.

Several problems exist with the above type of safety cases. First, children can access cases of this type which are left open. Secondly, the cases are subject to vandalism by using a tool to force open the case. Thus, theft is not prevented or access by children who are curious and ambitious enough to force open the case. Thirdly, if the hand gun owner needs quick access to the weapon, this is not available, since it is time consuming to unlock the case, remove the rod, or in case of combination locks, to work the combination, and, then, remove the rod.

What is needed is a safety storage device for a hand gun that provides for safe storage, provides easy access for the owner of the weapon, is difficult to break into and provides no clue to any person other than the owner of how to enter the container. The present invention addresses these problems as well as providing for an inexpensive light weight container.

SUMMARY OF THE INVENTION

The present invention provides a firearm safety storage container or box which can be tailored to fit most hand guns, and, if desired, any other type of firearm.

The firearm safety storage box of the present invention comprises:

(a) a substantially rectangular frame structure having a plurality of openings formed therein for receiving wall panels;

(b) a plurality of wall panels attachable to the frame, the wall panels for covering all the openings except one opening which is used for accessing the box, the access opening being randomly selected at the time of assembly of the box, the wall panels being securable to the frame structure;

(c) means for permanently securing the wall panels to the frame structure;

(d) an access wall panel, the access panel covering the randomly selected access opening of the frame structure;

(e) a flexible protective lining insertable within the box, the lining having a top portion and a bottom portion, the bottom portion formed to receive a firearm and ammunition; and (f) means for securing the access panel to the frame structure.

The frame structure generally comprises a plurality of first elongated and smaller second supports. The supports are, preferably, made from aluminum, but may be made from steel or other material such as a durable plastic.

The elongated supports and the smaller supports are normally welded together to form the shape of a rectangular box. The supports have cavities formed therein to receive seating strips which provide seating for the wall panels. The seating strips are insertable within the supports. The seating strips are preferably made from aluminum, but may be made from steel or other durable material such as plastic.

The wall panels are formed to fit in the openings of the frame structure. The wall panels are, preferably, made from a durable mar-proof plastic but may be made from a durable lightweight metal.

At least one of the wall panels is be made from a bullet-proof material such as KEVLAR or the like. One of the panels is designated as the access panel at the time of assembly of the box and covers the randomly selected access opening.

The seating strips and the wall panels, except the access panel, are permanently attached to the frame structure by means for securing, such as a commercially available adhesive or the like. The adhesive permanently seals the strips and panels in place. The strips and panels may be secured to the frame structure by welding or the like.

The firearm and the ammunition for the firearm are placed within seats formed in the bottom portion of the lining. The lining, along with the firearm and ammunition, is placed within the box through the access opening which is, then, covered with the access panel.

After the access panel is positioned to the frame, the panel is removably secured thereto by means for securing the access panel, such as a flexible seal which is insertable into a cavity formed in the associated sealing strips. The seal or insertable seal is inserted between the panel and the strip and engages a flange formed on the seal strip.

Additional seals are provided and inserted between the panels and the remaining seal strips. Each seal is cut-to-size to fit the length of the associated strip and urges against each other at the ends after they are inserted in the strips. Each insertable seal is, preferably, made from rubber but may be made from a flexible plastic material.

When all the seals are in place, each panel looks similar to any other panel. Only the owner of the box knows which panel is removable to provide access to the firearm.

The outside surface of all the panels will be provided with writing, but only the access panel will have a recognizable code. With each panel looking identical to each other panel, except for size, it will be extremely difficult for anybody, not knowing the code, to identify the panel to be removed. Also, because the flexible seal is held in place by the flange, it is difficult for minor children to remove the seal.

The present invention will be better understood by reference to the following description of the drawings and the detailed description of the invention in which like reference numbers refer to like elements in both, and in which:

BRIEF DESCRIPTION OF THE DRAWINGS

FIG. 1 is a perspective of a firearm safety box in accordance with the present invention;

FIG. 2 is a plan view, partly in section, of the firearm safety box with a firearm associated therewith.

DETAILED DESCRIPTION OF THE INVENTION

Figure 3:
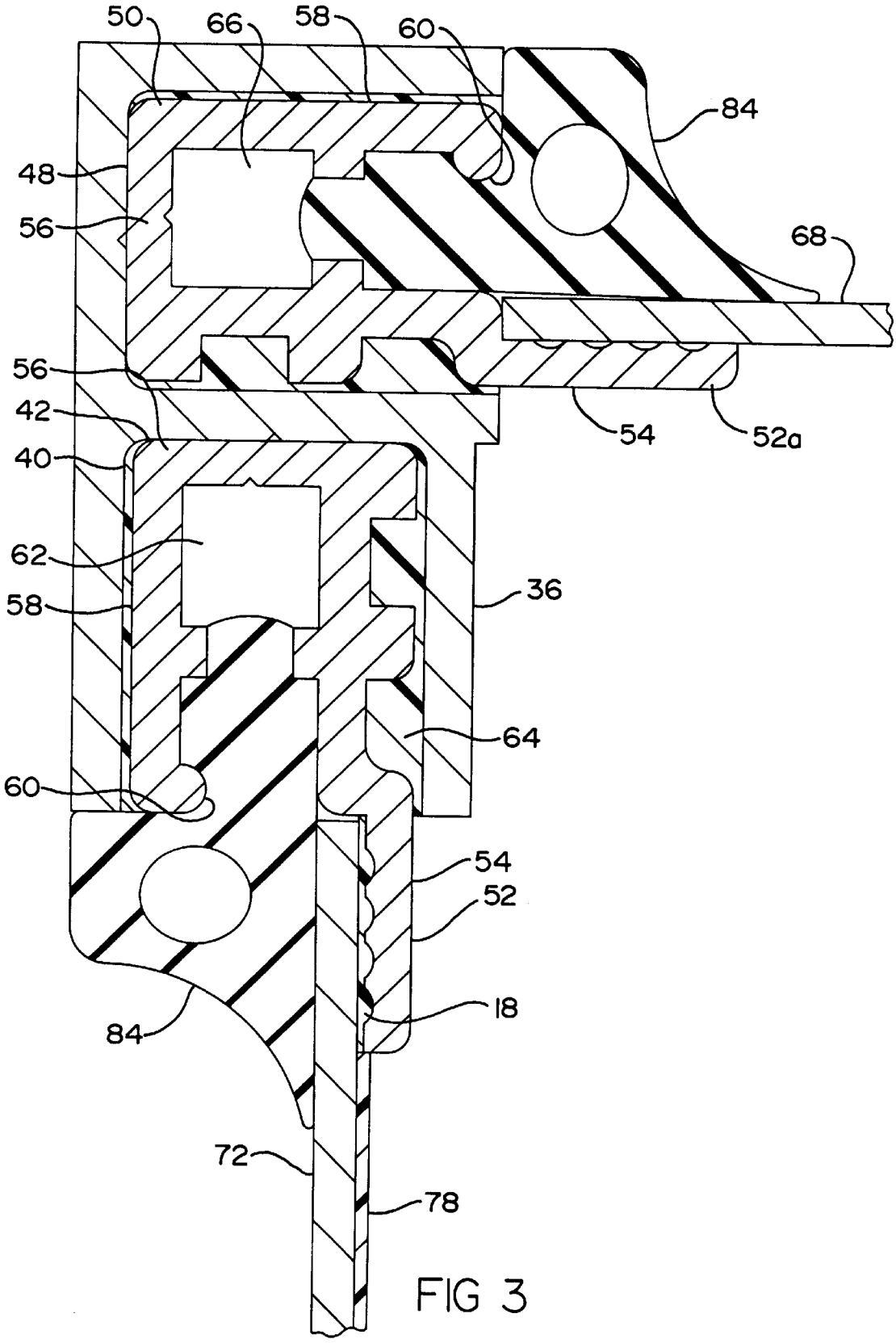
FIG. 3 is an enlarged sectional view of an intersecting corner of the box hereof, taken along line 3—3 of FIG. 1.

Now with reference to the drawings, FIGS. 1–3, there is depicted therein a firearm safety box, generally, designated as 10. The firearm safety box accommodates a hand gun and the ammunition in a safe environment away from children. The firearm safety box 10 of the present invention, generally, comprises:

(a) a substantially rectangular frame structure 12 having a plurality of openings 14 formed therein; and, (b) a plurality of attachable wall panels 16, one wall panel 16 covering an associated opening 14.

Additionally, the box is provided with an opening 14*a* used for accessing the box 10, the opening or access opening 14*a* is randomly selected at the time of assembly of the box 10. The attachable wall panels 16 are securable to the frame structure 12 via means 18 for permanently securing the wall panels 16 to the frame structure 12.

The present invention, also, includes an access wall panel 16*a,* the access panel 16*a* covering the randomly selected access opening 14*a* of the frame structure 12.

A flexible protective lining 20 is insertable within the box 10. The lining 20 has a top portion 22 and a bottom portion 24. The bottom portion 24 is formed to receive a firearm 26 and ammunition 28.

In accordance herewith, the present invention further provides means 30 for securing the access panel 16*a* to the frame structure 12 after the lining 20 is inserted into the box 10.

More particularly, and as shown, the frame structure 12 is preferably a rectangular shaped structure having four side openings 32 and two end openings 34. The frame structure 12 is preferably comprised of four elongated or first length supports 36 and eight smaller or shorter or second length supports 46 configured to form the rectangular shaped frame 12.

The elongated supports 36 are, each, disposed at an associated corner 38 of the frame 12. Each elongated support 36 has a first receiving slot 40 and a second receiving slot 42 formed therein. Each slot 42 is substantially normal to its associated first receiving slot 40.

The shorter supports 46 are attachable to opposing elongated supports 36 and to two other smaller supports 46 by any suitable means, such as welding or the like.

As shown, each smaller support 46 has a third receiving slot 48 and a fourth receiving slot 50 formed therein, the slot 50 being substantially normal to the third receiving slot 48.

The supports 36, 46 are, preferably, made from aluminum, but may be made from other metals or plastic. A plurality of elongated insertable strips 52 for seating the wall panels 16 are disposed in the slots 40, 42 of the elongated supports 36. The strips 52 are essentially J-shaped members with a first wall 58, a base 56 and a second wall 58. The first wall 54 is parallel to and higher than the second wall 58. The second wall 54 has a flange 60 formed thereon substantially normal to the second wall 58 and extending toward the first wall 54. The first wall 54, base 56 and the second wall 58 define a first cavity 62 for receiving a wall panel 16. Means 64 for sealing the wall panel 16, such as an adhesive, seals the remaining space in the cavity 62 between the wall panel and the second wall 58 of the strip 52.

Strips 52*a* are securable within the third and fourth receiving slots 48, 50 of the smaller supports 46. The strips 52*a* are configured the same as the strips 52. The strips 52*a* have a second cavity 66 formed therein for receiving an edge of a wall panel 16. The insertable strips 52, 52*a* are, preferably, made from aluminum, but may be made from another metal or a durable plastic.

The panels 16 defining the side panels are insertable within the first cavity 62 of the elongated strips 52 and the second cavity 66 of the smaller strips 52*a* which are disposed within the third slots 48 of the smaller supports 46. One panel 16*a* is identified as an unsecured access panel.

As shown, the end panels are insertable within the smaller strips 52. The end panels are inserted within the second cavity 66 of the smaller strips 52*a* which are formed within the fourth receiving slot 50 of the smaller supports 46.

The strips 52, 52*a* and the end panels, are permanently sealed via suitable means, such as an adhesive. Thus, the adhesive is used on all panels 16 except for the unsecured access panel 16*a*.

As noted above, the flexible protective lining 20 to be disposed within the box 10 has a top portion 22 and a bottom portion 24. The bottom portion 24 has a first seat 74 formed therein for seating a firearm 26 and a second seat 76 formed therein for ammunition 28 for the firearm 26. The top portion 22 covers the bottom portion 24. The lining 20 may be made from a flexible rubber or plastic foam which is commercially available.

Also disposed and suspended within the box 10 is at least one bullet-proof panel 78. The bullet-proof panel 78 is attached to the second supports 46 at one or both ends of the box 10, as shown. The bullet-proof panel 78 is, preferably, secured to an end panel. The bullet-proof panel 78 is, preferably, sealed with the end panel to the smaller supports when the end panels are installed. The bullet-proof panel 78 is, preferably, made from Kevlar or another commercially available bullet-proof material.

The end panels are firmly held in place as to prevent their removal by force. The end panels are made from a durable polymeric plastic or the like. Alternatively, the side panels and the end panels may be made from a durable light metal such as aluminum.

The panel 16*a,* either a side or end panel, but preferably a side panel, remains unsealed to permit access to the inside of the box 10. In use, this panel is randomly designated at the time of assembly and is only disclosed to the dealer for the box 10 and the purchaser of the box 10.

The panel 16*a* is removable for loading the firearm 26 and ammunition 28 and for moving the firearm into and out of the box 10. The access opening 14*a* permits the flexible liner 20, the firearm 26 and the ammunition 28 to be inserted into the box 10. Once the liner 20, the firearm 26 and ammunition 28 are installed in the box 10, the access panel 16*a* is put in place.

In use, the firearm 26 should always be placed in the box 10 such that the muzzle of the firearm is facing the bullet-proof panel 78.

The access panel 16*a* is secured in place by means 30. The means 30, preferably, comprises a flexible seal 80. The seal 80 is, preferably, made from rubber, but may be made from any commercially available flexible plastic or the like.

The access panel 16*a* may also have means 86 for holding the panel 16*a* in place until the means 30 for securing the panel is applied. The means 86, preferably, comprises strips of loop and hook material, such as that available under the name VELCRO or the like. The strips of material are attached to the inside of the access panel 16*a* proximate the seating edges and along the insertable strips 52, 52*a* opposite the seating edges of the panel 16*a*. The means 86 for holding holds the panel until the flexible seal 80 is installed.

The elongated flexible seal 80 is insertable into the first cavity 62 of the elongated insertable strip 52 between the elongated side panel 16 and the second wall 58 of the strip 52, as shown.

As shown, there are, preferably, eight elongated, or first length, flexible seals 82 and sixteen smaller, or second size, flexible seals 84 which are installed in the box 10. Each elongated flexible seal 82 is held in place by the flange 60 of the associated insertable strip 52.

Each smaller flexible seal 84 is insertable into the second cavity 66 of the associated second or smaller insertable strips 52*a*. The flange 60 on the second wall 58 of the strips 52 hold the flexible seals 84 in place. The flanges 60 firmly secure the flexible seals 82, 84 in place such that they may not be easily removed by minor children.

In use, all the flexible seals 80, 82, 84 look exactly the same when installed in the box 10 at assembly. The seller of the firearm safety box 10 instructs the purchaser which panel 16*a* is removable from the box 10. When the purchaser is ready to insert the firearm 26 into the box 10, the user removes the flexible seal 80 which holds the access panel 16*a* in place. The user then removes the liner 20 from the box 10, separates the portions 22, 24, inserts the firearm 26 into the first seat 74 of the bottom portion 24, and places the ammunition 28 into the second seat 76. The user places the top portion 22 of the liner 20 over the bottom portion 24 and installs the firearm 26 and ammunition 28 into the box 10, insuring that the muzzle of the firearm is facing the bullet proof panel 78. When the liner 20 is in place within the box 10, the user places the access panel 16*a* over the opening 14*a* in the box 10 and replaces the seal 80.

The secret or undisclosed panel and the design of the flexible seals combine to provide a safe and reasonably child proof firearm safety storage box. The entire box is designed to confuse a child and to make the flexible seals only removable by adults. The effort to provide for child safety also reduces the ability of another person tampering with and forcing the box open.

The firearm safety storage box 10 may be used to store and secure items other than handguns. The box 10 may be used to store jewelry and other valuable property. Additionally, the box 10 may be used to securely display valuable items. In such a case, the side and end panels may be a transparent plastic or tamper-proof unbreakable glass.

Having thus described the invention, what is claimed is:

1. A firearm safety storage box, comprising:

(a) a frame structure having a plurality of first openings formed therein for receiving wall panels and a predetermined access opening;

(b) a plurality of wall panels, one panel for each first opening, each wall panel being securable to the frame structure to cover its respective first opening;

(c) means for permanently securing the wall panels to the frame structure;

(d) a removable access wall panel, the access panel covering the access opening of the frame structure;

(e) a flexible protective lining insertable within the box, the lining having a top portion and a bottom portion, the bottom portion formed to removably seal a firearm; and (f) means for removably securing the access panel to the frame structure, and wherein the means for removably securing is not visually distinct from the means for permanently securing upon visual inspection of the safety storage box.

2. The firearm safety storage box of claim 1 wherein the frame structure comprises:

(a) a plurality of first supports, the supports being disposed at each corner of the box; and (b) a plurality of second supports, each having a length shorter than the first support, and being attached to the elongated supports, the supports cooperating to define a rectangular frame structure.

3. The firearm storage box of claim 2 further comprising:

a plurality of seating strips, insertable within the first supports.

4. The firearm storage box of claim 3 further comprising:

a plurality of second seating strips, the second strips being insertable within the second supports, the wall panels being held in place by the strips.

5. The frame structure of claim 4 further comprising:

means for permanently securing the strips in position.

6. The firearm storage box of claim 1 wherein the protective lining further comprises:

a bottom portion having a first seat formed therein for seating a firearm and a second seat formed therein for seating ammunition for the firearm.

7. The firearm safety storage box of claim 1 wherein the means for securing the panels is an adhesive.

8. The firearm safety storage box of claim 1 wherein the means for removably securing the access panel is a flexible rubber seal.

9. The firearm safety storage box of claim 1 further comprising:

at least one bullet-proof panel disposed within the box, the bullet-proof panel being attachable to a wall panel.

10. The firearm safety storage box of claim 3 wherein each first support has a first receiving slot formed therein and a second receiving slot formed therein substantially normal to the first receiving slot for receiving an associated insertable strip.

11. The firearm safety storage box of claim 4 wherein each second support has a third receiving slot formed therein and a fourth receiving slot formed therein substantially normal to the third receiving slot for receiving the second insertable strips.

12. The firearm safety storage box of claim 11 wherein each strip is substantially J-shaped with a first wall, a base, and a second wall, the first wall being higher than the second wall, the second wall having a flange formed thereon substantially normal to the second wall and extending toward the first wall, the first wall cooperatively, base, and the second wall cooperatively defining a first cavity therebetween for receiving an edge of a panel and a flexible seal.

* * * * *